United States Patent [19]

Low et al.

[11] Patent Number: 5,003,118

[45] Date of Patent: Mar. 26, 1991

[54] ISOMERIZATION OF BENZENE-CONTAINING FEEDSTOCKS

[75] Inventors: Chi-Chu D. Low, Lisle; Visnja A. Gembicki, Clarendon Hills; Robert S. Haizmann, Rolling Meadows, all of Ill.

[73] Assignee: UOP, Des Plaines, Ill.

[21] Appl. No.: 459,402

[22] Filed: Dec. 29, 1989

[51] Int. Cl.[5] ..... C07C 5/22; C07C 7/163; C07C 5/13

[52] U.S. Cl. ..... 585/253; 585/258; 585/734; 585/737; 585/750; 585/751

[58] Field of Search ..... 585/253, 258, 734, 737, 585/750, 751

[56] References Cited

U.S. PATENT DOCUMENTS

| | | | |
|---|---|---|---|
| 2,915,571 | 12/1959 | Haensel | 260/683.68 |
| 2,999,890 | 9/1961 | Davison | 585/253 |
| 3,192,286 | 6/1965 | Houston, Jr. et al. | 585/253 |
| 3,233,001 | 2/1966 | Merryfield et al. | 585/253 |
| 3,250,816 | 5/1966 | Waloby | 585/258 |
| 3,277,194 | 10/1966 | Cabbage | 585/253 |
| 3,527,695 | 9/1970 | Lawrance et al. | 585/258 |
| 3,631,117 | 12/1971 | Kovach et al. | 260/666 |
| 3,761,392 | 9/1973 | Pollock | 208/93 |
| 4,181,599 | 1/1980 | Miller et al. | 208/79 |
| 4,457,832 | 7/1984 | Robinson | 208/66 |
| 4,834,866 | 5/1989 | Schmidt | 208/65 |

*Primary Examiner*—H. M. S. Sneed
*Assistant Examiner*—James Saba
*Attorney, Agent, or Firm*—Thomas K. McBride; John G. Tolomei

[57] ABSTRACT

The benzene content in a gasoline pool is reduced by a process that hydrogenates a benzene-containing isomerization zone feedstream. In addition to reducing the benzene concentration, the hydrogenation zone is also used to heat the isomerization zone feed and thereby eliminate the need for an isomerization zone heater. The process employs mild saturation conditions which eliminates hydrocracking and prevents the loss of isoparaffin yield. Additional cyclic hydrocarbons produced by the saturation of benzene can be processed in the isomerization zone for ring opening to increase the available paraffinic feedstock or the isomerization zone can be operated to pass the cyclic hydrocarbons through to a product recovery section.

9 Claims, 1 Drawing Sheet

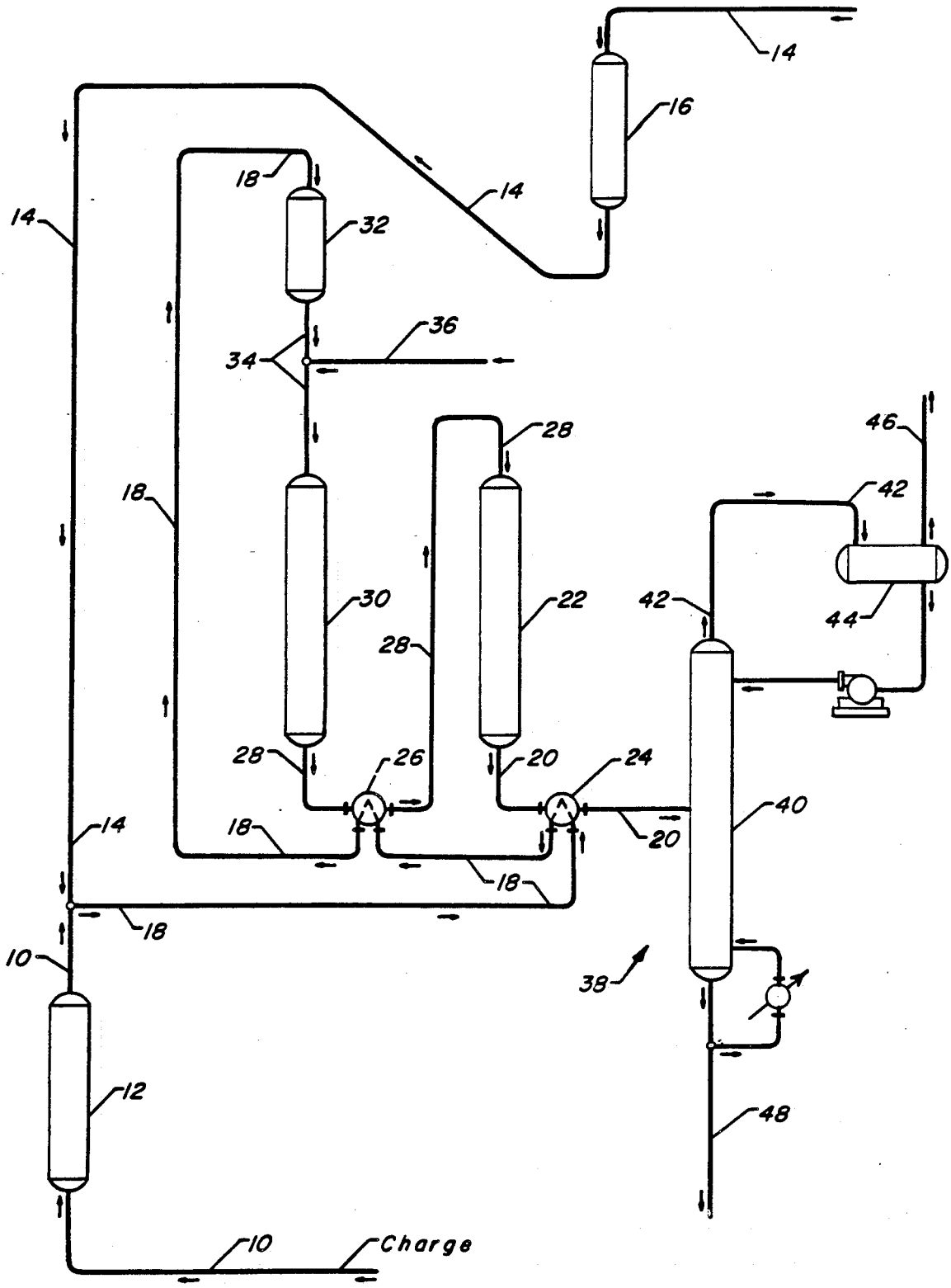
14
16
14
18
32
14
36
34
28
46
18
42
30
22
42
44
28
28
26
20
24
40
14
18
20
18
18
10
38
12
48
10
Charge

ISOMERIZATION OF BENZENE-CONTAINING FEEDSTOCKS

BACKGROUND OF THE INVENTION

This invention relates generally to the isomerization of hydrocarbons. This invention relates more specifically to the processing of benzene-containing hydrocarbon feeds and the isomerization of light paraffins.

DESCRIPTION OF THE PRIOR ART

High octane gasoline is required for modern gasoline engines. Formerly it was common practice to accomplish octane number improvement by the use of various lead-containing additives. As lead is phased out of gasoline for environmental reasons, it has become increasingly necessary to rearrange the structure of the hydrocarbons used in gasoline blending in order to achieve high octane ratings. Catalytic reforming and catalytic isomerization are two widely used processes for this upgrading.

A gasoline blending pool is usually derived from naphtha feedstocks and includes $C_4$ and heavier hydrocarbons having boiling points of less than 205° C (395° F) at atmospheric pressure. This range of hydrocarbon includes $C_4$–$C_9$ paraffins, cycloparaffins and aromatics. Of particular interest have been the $C_5$ and $C_6$ normal paraffins which have relatively low octane mumbers. The $C_4$–$C_6$ hydrocarbons have the greatest susceptibility of octane improvement by lead addition and were formerly upgraded in this manner. Octane improvement can also be obtained by catalytically isomerizing the paraffinic hydrocarbons to rearrange the structure of the paraffinic hydrocarbons into branch-chained paraffins or reforming to convert the $C_6$ and heavier hydrocarbons to aromatic compounds. Normal $C_5$ hydrocarbons are not readily converted into aromatics, therefore, the common practice has been to isomerize these lighter hydrocarbons into corresponding branch-chained isoparaffins. Although the non-cyclic $C_6$ and heavier hydrocarbons can be upgraded into aromatics through dehydrocyclization, the conversion of $C_6$'s to aromatics creates higher density species and increases gas yields with both effects leading to a reduction in liquid volume yields. Therefore, it is preferable to charge the non-cyclic $C_6$ paraffins to an isomerization unit to obtain $C_6$ isoparaffin hydrocarbons. Consequently, octane upgrading commonly uses isomerization to convert normal $C_6$ and lighter boiling hydrocarbons and reforming to convert $C_6$ cycloparaffins and higher boiling hydrocarbons.

In the reforming processing, $C_6$ cycloparaffins and other higher boiling cyclic hydrocarbons are converted to benzene and benzene derivatives. Since benzene and these derivatives have a relatively high octane value, the aromatization of these naphthenic hydrocarbons has been the preferred processing route. However, many countries are contemplating or have enacted legislation to restrict the benzene concentration of motor fuels. Therefore, processes are needed for reducing the benzene content of the gasoline pool while maintaining sufficient conversion to satisfy the octane requirements of modern engines.

Combination processes using isomerization and reforming to convert naphtha range feedstocks are well known. U.S. Pat. No. 4,457,832 uses reforming and isomerization in combination to upgrade a naphtha feedstock by first reforming the feedstock, separating a $C_5$–$C_6$ paraffin fraction from the reformate product, isomerizing the $C_5$–$C_6$ fraction to upgrade the octane number of these components and recovering a $C_5$14 $C_6$ isomerate liquid which may be blended with the reformate product. U.S. Pat. Nos. 4,181,599 and 3,761,392 show a combination isomerization-reforming process where a full range naphtha boiling feedstock enters a first distillation zone which splits the feedstock into a lighter fraction that enters an isomerization zone and a heavier fraction that is charged as feed to a reforming zone. In both the '392 and '599 patents, reformate from one or more reforming zones undergoes additional separation and conversion, the separation including possible aromatics recovery, which results in additional $C_5$–$C_6$ hydrocarbons being charged to the isomerization zone.

The benzene contribution from the reformate portion of the gasoline pool can be decreased or eliminated by altering the operation of the reforming section. There are a variety of ways in which the operation of the refining section may be altered to reduce the reformate benzene concentration. Changing the cut point of the naphtha feed split between the reforming and isomerization zones from 180° to 200° F. will remove benzene, cyclohexane and methylcyclopentane from the reformer feed. Benzene can alternately also be removed from the reformate product by splitting the reformate into a heavy fraction and a light fraction that contains the majority of the benzene. Practicing either method will put a large quantity of benzene into the feed to the isomerization zone.

The isomerization of paraffins is a reversible reaction which is limited by thermodynamic equilibrium. The basic types of catalyst systems that are used in effecting the reaction are a hydrochloric acid promoted aluminum chloride system and a supported aluminum chloride catalyst. Either catalyst is very reactive and can generate undesirable side reactions such as disproportionation and cracking. These side reactions not only decrease the product yield but can form olefinic fragments that combine with the catalyst and shorten its life. One commonly practiced method of controlling these undesired reactions has been to carry out the reaction in the presence of hydrogen. With the hydrogen that is normally present and the high reactivity of the catalyst, any benzene entering the isomerization zone is quickly hydrogenated. The hydrogenation of benzene in the isomerization zone increases the concentration of napthenic hydrocarbons in the isomerization zone.

A large percentage of the $C_4$–$C_6$ paraffin fractions that are available as feedstocks for $C_4$–$C_6$ isomerization processes include cyclic hydrocarbons. Cyclic hydrocarbons present in the reaction zone or formed in the reaction zone tend to be absorbed on the isomerization catalysts. Absorption of the cyclic compounds blocks active sites on the catalyst and thereby inhibits the isomerizable paraffins from the catalyst. This exclusion diminishes the overall conversion of the process. As a result, removal of cyclic hydrocarbons from an isomerization process has been generally practiced to increase conversion of the paraffins to more highly branched paraffins. Complete removal of cyclic hydrocarbons by ordinary separation cannot be achieved due to the boiling points of the $C_6$ paraffins and many of the cyclic hydrocarbons, in particular, normal hexane and methycyclopentane.

If it also known to eliminate cyclic hydrocarbons by opening rings. U.S. Pat. No. 2,915,571 teaches the reduction of naphthenes in an isomerization feed fraction by contact with a ring opening catalyst containing an iron group metal in a first reaction zone, and subsequent isomerization of the feed fraction by contact with a different catalyst in an isomerization zone. Opening of the cyclic hydrocarbons has the two fold advantage of eliminating the cyclic hydrocarbons that can cause catalyst fouling and increasing the volume of lower density isomerizable hydrocarbons that in turn increases product yields. The use of different catalysts for ring opening and isomerization imposes a major drawback on the process of U.S. Pat. No. 2,915,571 since it requires at least one additional reaction zone. U.S. Pat. No. 3,631,117 describes a process for the hydroisomerization of cyclic hydrocarbons that uses a zeolite supported Group VIII metal as a ring opening catalyst at high severity conditions and as an isomerization catalyst at low severity conditions to obtain cyclic isomers having at least one less carbon atom per ring than the unconverted cyclic hydrocarbons. It is also known from U.S. Pat. No. 4,834,866 that rings can be opened in an isomerization zone using a chlorided platinum alumina catalyst at moderate isomerization conditions. When high severity operating conditions are used to open rings, substantial cracking of $C_4$–$C_6$ hydrocarbons to light ends will also occur. Therefore, high severity conditions to open rings in $C_4$–$C_6$ hydrocarbon feedstocks are usually avoided.

Apart from any problems posed by the saturation of the benzene and the resulting increase in the concentration of cyclic hydrocarbons, the saturation of benzene has the disadvantage of raising the temperature in the isomerization zone. In order to achieve a desired conversion, the feed to the isomerization zone is heated to a temperature that will promote the isomerization reaction. The additional heat resulting from benzene saturation can raise the temperature of the isomerization zone above that which will provide the highest conversion of less highly branched $C_5$ and $C_6$ hydrocarbons to more highly branched $C_5$ and $C_6$ hydrocarbons. It has now been discovered that the heat generated by the saturation of benzene can be advantageously used to simplify the arrangement for the isomerization zone while heating the isomerization feed to the desired temperature for $C_5$ and $C_6$ paraffin conversion.

It is, therefore, an object of this invention to provide a process that will facilitate the removal of benzene from the gasoline pool.

It is a further object of this invention to advantageously utilize the heat generated by the saturation of benzene in the isomerization zone.

A yet further object of this invention is to provide an isomerization process for isomerizing benzene containing hydrocarbon streams.

BRIEF DESCRIPTION OF THE INVENTION

This invention is a process for converting a feedstock comprising $C_4$–$C_7$ paraffins and $C_5$–$C_7$ cyclic hydrocarbons including benzene. This invention uses a hydrogenation zone upstream of the isomerization reactors to saturate benzene and simultaneously heat the feed to the isomerization zone. Saturation of the benzene allows the charge heater, used in most isomerization zone arrangements, to be by-passed or eliminated from the flow scheme. The use of a separate hydrogenation zone also lowers the overall temperature of the isomerization zone feed as the benzene is saturated—lower temperatures minimize undesirable hydrocracking reactions. Also performing the highly exothermic benzene saturation reaction in a lead reactor that has a lower temperature reduces the coking that would normally occur in the isomerization zone as a result of the higher overall temperatures.

Accordingly in one embodiment, this invention is a process for the isomerization of a $C_4$–$C_6$ paraffinic feedstock that contains at least 1 wt.% benzene. The process includes the steps of combining the feedstock with a hydrogen-rich gas stream to produce a combined feed. The combined feed is passed to a hydrogenation zone and contacted therein with a hydrogenation catalyst to saturate benzene and heat the feedstream. The saturated feedstream is recovered from the hydrogenation zone and has a benzene concentration of less than 0.1 wt.%. At least a portion of the saturated feedstream is passed from the hydrogenation zone to an isomerization zone without heating and contacted with an isomerization catalyst at isomerization conditions.

In a yet further embodiment, this invention is a process for the isomerization of $C_5$–$C_6$ paraffinic feedstock that contain at least 1 wt.% benzene. The process combines the feedstock with a hydrogen-rich gas to produce a combined feed that is passed at a temperature of from 100° to 150° F to an hydrogenation zone and contacted therein with a hydrogenation catalyst. Contact with the hydrogenation catalyst saturated the benzene and heats the feedstream to a temperature of from 200 to 450° F. The saturated feedstream has a benzene concentration of less than 0.1 wt.% and is passed from the hydrogenation zone to an isomerization zone. The saturated feedstream is contacted with an isomerization catalyst in the isomerization zone to isomerize $C_5$–$C_6$ hydrocarbons. An isomerate product essentially free of benzene is recovered from the isomerization zone.

Other embodiments, aspects and details of this invention are disclosed in the following detailed description of the invention.

BRIEF DESCRIPTION OF THE DRAWING

The FIGURE shows a preferred arrangement for the process of this invention.

DETAILED DESCRIPTION OF THE INVENTION

A basic arrangement for the processing equipment used in this invention can be readily understood by a review of the flow scheme presented in the FIGURE. The FIGURE and this description make no mention of pumps, compressor, receivers, condensers, reboilers, instruments and other well-known items of processing equipment in order to simplify the explanation of the invention. Looking then at the FIGURE, a feedstream comprising $C_5$ and $C_6$ paraffins along with at least 1 wt.% benzene enter the process through line 10 and pass through a drier 12 that removes water and any other catalyst poisons from the feedstream. Make-up hydrogen enters the process through line 14 and passes through a drier 16 for removal of water. The feedstock of line 10 and the hydrogen from line 14 are combined in a line 18 to form a combined feed. The combined feed is heat exchanged in an exchanger 24 against the contents of line 20 which carries the effluent from a second isomerization reactor 22. The contents of line 18 are further heat exchanged in an exchanged 26 against the contents of line 28 which carries the effluent from a first isomerization reactor 30. A hydrogenation reactor 32 receives the contents of line 18. The hydrogenation reactor saturates benzene in the combined feed and further heats the combined feed. A line 34 carries a saturated feed from hydrogenation reactor 32 to the first isomerization reactor 30. A chloride-containing compound is injected into the contents of line 34 by a line 36. A first stage of isomerization takes place in reactor 30. Following the first stage of isomerization, line 28 carries the partially cooled isomerization effluent from reactor 30 to reacter 22. After further isomerization in reactor 22, an isomerate product is taken by line 20 to a fractionation section 38. A fractionation column 40 removes light gases from the isomerate products which are taken overhead by line 42 and withdrawn from the process through the top of a receiver 44 via line 46. The stabilized isomerate product is withdrawn from the bottom of fractionator 40 by line 48.

Suitable feedstocks for this invention will include $C_4$ plus hydrocarbons up to an end boiling point of about 250° C. (482° F.). The feedstocks that are used in this invention will typically include hydrocarbon fractions rich in $C_4$–$C_6$ normal paraffins. The term "rich" is defined to mean a stream having more than 50% of the mentioned component. In addition, the feedstock will include significant amounts of benzene. In order to realize the advantages of this invention, the concentration of benzene in the feedstock will at least equal 1 wt.% and will normally be higher. Preferably, in order to obtain substantial heating of the feed, the concentration of benzene will equal 10 to 25 wt.%. Normally, the minimum concentration is 2 wt.%. The upper limit on the concentration of benzene is dictated by the need to have sufficient paraffinic hydrocarbons present for isomerization and to limit the loss of benzene. The other feed components will usually comprise $C_5$–$C_6$ cyclic and paraffinic hydrocarbons with normal and isohexane providing most of the paraffinic components.

As hereinafter described in more detail, some of the possible isomerization zone catalysts suitable for use in this invention are highly sensitive to water and other contaminants. In order to keep water content within acceptable levels for such catalysts, all of the isomerization zone feed passes first through a drying zone. The drying zone for this purpose may be of any design that will reduce water content 0.1 ppm or less. Suitable adsorption processes for this purpose are well known in the art. The isomerization zone catalyst is often sulfur sensitive. Suitable guard beds or adsorptive separation processes may be used to reduce the sulfur concentration of the feedstock. The FIGURE shows the treatment of the feedstock upstream of the hydrogen addition point and the hydrogenation zone; however, the feedstock may be treated for any necessary. water and contaminant removal at any point upstream of the insomerization catalyst.

A hydrogen steam is combined with the feedstock to provide hydrogen for the hydrogenation and isomerization zones. When the hydrogen is added downstream of the feedstock treating section, the hydrogen stream also undergoes drying of other treatment necessary for the substained operation of the isomerization zone or hydrogenation zone. The hydrogenation of benzene in the hydrogenation zone results in a net consumption of hydrogen. Although hydrogen is not consumed by the isomerization reaction, the isomerization of the light paraffins is usually carried out in the presence of hydrogen. Therefore, the amount of hydrogen added to the feedstock should be sufficient for both the requirements of the hydrogenation zone and the isomerization zone.

The amount of hydrogen admixed with the feedstock varies widely. For the isomerization zone alone, the amount of hydrogen can vary to produce anywhere from a 0.01 to a 10 hydrogen to hydrocarbon ratio in the isomerization zone effluent. Consumption of hydrogen in the hydrogenation zone increases the required amount of hydrogen admixed with the feedstock. The input through the hydrogenation zone usually requires a relatively high hydrogen to hydrocarbon ratio to provide the hydrogen that is consumed in the saturation reaction. Therefore, hydrogen will usually be mixed with the feedstock in an amount sufficient to creat a combined feed having a hydrogen to hydrocarbon ratio of from 1 to 5. Lower hydrogen to hydrocarbon ratios in the combined feed are preferred to simplify the system and equipment associated with the addition of hydrogen. At minimum, the hydrogen to hydrocarbon ratio must supply the stoichiometric requirements for the hydrogenation zone. In order for the hydrogenation zone to operate at the mild conditions of this invention, it is preferable that an excess of hydrogen be provided with the combined feed. Although no net hydrogen is consumed in the iosomeriation reaction, the isomerization zone will have a net consumption of hydrogen often referred to as the stoichiometric hydrogen requirement which is associated with a number of side reactions that occur. These side reactions include saturation of olefins and aromatics, cracking and disproportionation. Due to the presence of the hydrogenation zone, little saturation of olefins and aromatics will occur in the isomerization zone. Nevertheless, hydrogen in excess of the stoichiometirc amounts for the side reactions is maintained in the isomerization zone to provide good stability and conversion by compensating for variations in feedstream compositions that alter the stoichiometric hydrogen requirements and to prolong catalyst life by suppressing side reactions such as cracking and disproportionation. Side reactions left unchecked reduce conversion and lead to the formation of carbonaceous compounds, i.e., coke, that foul the catalyst. As a result, the effluent from the hydrogenation zone should contain enough hydrogen to satisfy the hydrogen requirements for the isomerization zone.

It has been found to be advantageous to minimize the amount of hydrogen added to the feedstock. When the hydrogen to hydrocarbon ratio at the effluent of the isomerization zone exceeds about 0.05, it is not economically desirable to operte the isomerization process without the recover and recycle of hydrogen to supply a portion of the hydrogen requirements. Facilities for the recovery of hydrogen from the effluent are needed to prevent the loss of product and feed components that can escape with the flashing of hydrogen from the isomerization zone effluent. These facilities add to the cost of the process and complicate the operation of the process. The isomerization zone can be operated with the effuent hydrogen to hydrocarbon ratio as low as 0.05 without adversely affecting conversion or catalyst stability. Accordingly where possible, the addition of hydrogen to the feedstock will be kept to below an amount that will produce a hydrogen to hydrocarbon ratio in excess of 0.05 in the effluent from the isomerization zone.

The combined feed comprising hydrogen and the feedstock enter the hydrogenation zone. The hydrogenation zone is designed to saturate benzene at relatively mild conditions. The hydrogenation zone will comprise a bed of catalyst for promoting the hydrogenation of benzene. Preferred catalyst compositions will include platinum group, tin or cobalt and molydenum metals on suitable refractory inorganic oxide supports such as alumina. The alumina is preferably an anhydrous gamma-alumina with a high degree of purity. The term platinum group metals refers to noble metals excluding silver and gold which are selected from the group consisting of platinum, palladium, germanium, ruthenium, rhodium, osmium, and iridium.

Such catalysts have been found to provide satisfactory benzene saturation at conditions including temperatures as low as 90° F., pressures from 300 to 700 psig, a hydrogen to hydrocarbon ratio in the range of .1 to 2, and a 1 to 8 liquid hourly space velocity (LHSV). In the preferred arrangement of this invention, the feed entering the hydrogenation zone will be heated to a temperature in the range of 200 to 250° F by indirect heat exchange with the effluent or effluents from the isomerization zone. Lower temperatures are found to be most desirable for the hydrogenation reactions since they minimize unwanted disproportionation and cracking reactions that reduce the yield of the isomerization zone product. The exothermic saturation reaction increases the heat of the combined feed and saturates essentially of the benzene contained therein. The effluent from the hydrogenation zone provides a saturated feed for the isomerization zone that will typically contain less than 0.1 wt.% benzene.

Saturated feed from the hydrogenation zone enters the isomerization zone for the rearrangement of the paraffins contained therein from less highly branched hydrocarbons to more highly branched hydrocarbons. Furthermore, if there are any unsaturated compounds that enter the isomerization zone after passage through the hydrogenation zone, these residual amounts of unsaturated hydrocarbons will be quickly saturated in the isomerization zone. The isomerization zone uses a solid isomerization catalyst to promote the isomerization reaction. There are a number of different isomerization catalysts that can be used for this purpose. The two general classes of isomerization catalysts use a noble metal as a catalytic component. This noble metal, usually platinum, is utilized on a chlorided alumina support when incorporated into one general type of catalyst and for the other general type of catalyst the platinum is present on a crystalline alumina silicate support that is typically diluted with an inorganic binder. Preferably, the crystalline alumina type support is a zeolitic support and more preferably a mordenite type zeolite. The zeolitic type isomerization catalysts are well known and are described in detail in U.S. Pat. Nos. 3,442,794 and 3,836,597.

Although either type of catalyst may be used in this invention, the preferred catalyst is a high cloride catalyst on an alumina base that contains platinum. The alumina is preferably an anhydrous gamma-alumina with a high degree of purity. The catalyst may also contain other platinum group metals. The term platimum group metals refers to noble metals excluding silver and gold which are selected from the group consisting of platinum, palladium, germanium, ruthenium, rhodium, osmium, and iridium. These metals demonstrate differences in activity and selectivity such that platinum has been found to be the most suitable for this process. The catalyst will contain from about 0.1 to 0.25 wt.% of the platinum. Other platinum group metals may be present in a concentration of from 0.1 to 0.25 wt.%. The platinum component may exist within the final catalytic composite as an oxide or halide or as an elemental metal. The presence of the platinum component in its reduced state has been found most suitable for this process.

The catalyst also contains a chloride component. The chloride component termed in the art "a combined chloride" is present in an amount from about 2 to about 10 wt.% based upon the dry support material. The use of chloride in amounts greater than 5 wt.% have been found to be the most beneficial for this process.

There are a variety of ways for preparing the catalytic composite and incorporating the platinum metal and the choride therein. The method that has shown the best results in this invention prepares the catalyst by impregnating the carrier material through contact with an aqueous solution of a water-soluble decomposable compound of the platinum group metal. For best results, the impregnation is carried out by dipping the carrier material in a solution of chloroplatinic acid. Additional solutions that may be used include ammonium chloroplatinate, bromoplatinic acid or platinum dichloride. Use of the platinum chloride compound serves the dual function of incorporating the platinum component and at least a minor quantity of the chloride into the catalyst. Additional amounts of the chloride must be incorporated into the catalyst by the addition or formation of aluminum chloride to or on the platinum-alumina catalyst base. An alternate method of increasing the chloride concentration in the final catalyst composite is to use an aluminum hydrosol to form the alumina carrier material such that the carrier material also contains at least a portion of the chloride. Halogen may also be added to the carrier material by contacting the calcined carrier material with an aqueous solution of the halogen acid such as hydrogen chloride.

It is generally known that high chlorided platinum-alumina catalysts of this type are highly sensitive to sulfur and oxygen-containing compounds. Therefore, the feedstock must be relatively free of such compounds. A sulfur concentration no greater than 0.5 ppm is generally required. The presence of sulfur in the feedstock serves to temporarily deactivate the catalyst by platinum poisoning. Activity of the catalyst may be restored by hot hydrogen stripping of sulfur from the catalyst composite or by lowering the sulfur concentration in the incoming feed to below 0.5 ppm so that the hydrocarbon will desorb the sulfur that has been absorbed on the catalyst. Water can act to permanently deactivate the catalyst by removing high chloride from the catalyst and replacing it with inactive aluminum hydroxide. Therefore, water, as well as oxygenates, in particular $C_1$-$C_5$ oxygenates, that can decompose to form water, can only be tolerated in very low concentrations. In general, this requires a limitation of oxygenates in the feed to about 0.1 ppm or less. As previously mentioned, the feedstock may be treated by any method that will remove water and sulfur compounds. Sulfur may be removed from the feedstock by hydrotreating. Adsorption processes for the removal of sulfur and water from hydrocarbon streams are also well known to those skilled in the art.

Operating conditions within the isomerization zone are selected to maximize the production of isoalkane product from the feed components. Temperatures within the reaction zone will usually range from about 40°-260° C. (105°-500° F.). Lower reaction temperatures are preferred for purposes of isomerization conversion since they favor isoalkanes over normal alkanes in equilibrium mixtures. The isoalkane product recovery can be increased by opening some of the cyclohexane rings produced by the saturation of the benzene. However, if it is desired, maximizing ring opening usually requires temperatures in excess of those that are most favorable from an equilibrium standpoint. For example, when the feed mixture is primarily $C_5$ and $C_6$ alkanes, temperatures in the range of 60°-160° C. are desired from a normal-isoalkane equilibrium standpoint but, in order to achieve significant opening of $C_5$ and $C_6$ cyclic hydrocarbon ring, the preferred temperature range for this invention lies between 100°-200° C. When it is desired to also isomerize significant amounts of $C_4$ hydrocarbons, higher reaction temperatures are required to maintain catalyst activity. Thus, when the feed mixture contains significant portions of $C_4$-$C_6$ alkanes the most suitable operating temperatures for ring opening and isoalkane euilibrium coincide and are in the range from 145°-225° C. The reaction zone may be maintained over a wide range of pressures. Pressure conditions in the isomerization of $C_4$-$C_6$ paraffins range from 7 barsg to 70 barsg. Higher pressures favor ring opening, therefore, the preferred pressures for this process are in the range of from 25 barsg to 60 barsg when ring opening is desired. The feed rate to the reaction zone can also vary over a wide range. These conditions include liquid hourly space velocities ranging from 0.5 to 12 $hr.^{-1}$, however, space velocities between 0.5 and 3 $hr.^{-1}$ are preferred.

Operation of the reaction zone also requires the presence of a small amount of an organic chloride promoter. The organic chloride promoter serves to maintain a high level of active chloride on the catalyst as small amounts of chloride are continuously stripped off the catalyst by the hydrocarbon feed. The concentration of promoter in the reaction zone is usually maintained at from 30 to 300 ppm. The preferred promoter compound is carbon tetrachloride. Other suitable promoter compounds include oxygen-free decomposable organic chlorides such as proplydichloride, butylchloride, and chloroform to name only a few of such compounds. The addition of chloride promoter after the hydrogenation reactor, as shown in the Figure, is preferably carried out at such a location to expose the promoter to the highest available temperature and assure its complete decomposition. The need to keep the reactants dry is reinforced by the presence of the organic chloride compound which may convert, in part, to hydrogen chloride. As long as the process streams are kept dry, there will be no adverse effect from the presence of small amounts of hydrogen chloride.

A preferred manner of operating the process is in a two-reactor, reaction zone system. The cataylst used in the process can be distributed equally or in varying proportions between the two reactors. The use of two reaction zones permits a variation in the operating conditions between the two reaction zones to enhance isoalkane production. The two reaction zones can also be used to perform cyclic hydrocarbon conversion in one reaction zone and normal paraffin isomerization in the other. In this manner, the first reaction zone can operate at higher temperature and pressure conditions that favor ring opening but performs only a portion of the normal to isoparaffin conversion. The two stage heating of the combined feed, e.g., as provided by exchangers 26 and 24, facilitates the use of higher temperatures therein in a first isomerization reactor. Once cyclic hydrocarbon rings have been opened by initial contact with the catalyst, the final reactor stage may operate at temperature conditions that are more favorable for isoalkane equilibrium.

Another benefit of using two reactors is that it allows partial replacement of the catalyst system without taking the isomerization unit off stream. For short periods of time, during which the replacement of catalyst may be necessary, the entire flow of reactants may be processed through only one reaction vessel while catalyst is replaced in the other.

Whether operated with one or two reaction zones, the effluent of the process will enter separation facilities for the recovery of an isoalkane product. At minimum, the separation facilities divide the reaction zone effluent into a product stream comprising $C_5$ and heavier hydrocarbons and a gas stream which is made up of $C_3$ ligther hydrocarbons and hydrogen. To the extent that $C_4$ hydrocarbons are present, the acceptability of these hydrocarbons in the product stream will depend on the blending characteristics of the desired product, in particular vapor pressure considerations. Consequently, $C_4$ hydrocarbons may be recovered with the heavier isomerization products or withdrawn as part of the overhead or in an independent product stream. Suitable designs for rectification columns and separator vessels to separate the isomerization zone effluent are well known to those skilled in the art.

When hydrogen is received for recycle from the isomerization zone effluent, the separation facilities, in simplified form, can consist of a product separator and a stabilizer. The product separator operates as a simple flash separator that produces a vapor stream rich in hydrogen with the remainder of its volume principally comprising $C_1$ and $C_2$ hydrocarbons. The vapor stream serves primarily as a source of recycle hydrogen which is usually returned directly to the hydrogenation process. The separator may contain packing or other liquid vapor separation devices to limit the carryover of hydrocarbons. The presence of $C_1$ and $C_2$ hydrocarbons in the vapor stream do not interfere 243 isomerization process, therefore, some additional mass flow for these components is accepted in exchange for a simplified column design. The remainder of the isomerization effluent leaves the separator as a liquid which is passed on to a stabilizer, typically a trayed column containing approxiamtely 40 trays. The column will ordinarily contain condensing and reboiler loops for the withdrawal of a light gas stream comprising at least a majority of the remaining $C_3$ hydrocarbons from the feed stream and a light bottoms stream comprising $C_5$ and heavier hydrocarbons. Normally when the isomerization zone contains only a small quantity of $C_4$ hydrocarbons, the $C_4$'s are withdrawn with the light gas stream. After caustic treatment for the removal of chloride compounds, the light gas stream will ordinarily serves as a fuel gas. The stabilizer overhead liquid, which represents the remainder of the isomerization zone effluent passes back to the fractionation zone as recycle input.

A simplfied flow scheme for use without hydrogen recycle stream was described in the Figure. In the arrangement of the Figure, all of the excess hydrogen from the isomerization zone is taken with the overhead stream from the stabilizer drum or receiver. Since, as a precondition for use of this arrangement, the amount of hydrogen entering the stablizer is low, the rejection of hydrogen with the fuel gas stream does not significantly increase the loss of product hydrocarbons.

In order to more fully illustrate the process, the following example is presented to demostrate the operation of the process utilizing the flow scheme of the Figure. This example is based in part on a computer simulation of the process and experience with other isomerization and fractionation systems. All of the numbers identifying vessels and lines correspond to those given in the Figure.

A $C_5$ plus naphtha feed having the composition given in the Table enters through line 10 and is combined with hydrogen to produce a combined feed. Passing the combined feed to a series of heat exchangers such as exchangers 24 and 26 heats the feed to a temperature of 125 °to 200 ° F. which then enters the hydrogenation reactor at a pressure of 500 psig. In the hydrogenation reactor, the combined feed is contacted with a catalyst comprising a platinum metal on a chlorided platinum alimina support at an LHSV of 8. Contact of the combined feed with the hydrogenation catalyst produces a saturated feedstream that is withdrawn by line 34 and has the composition listed in Table 1. The hydrogenation zone heats the saturated feed to a temperature of 250 ° to 350° F. and the saturated feed is passed on to the isomerization zone at a pressure of 490 psig.

Carbon tetrachloride is then added to the saturated feedstream at a rate of 150 wt. ppm which then enters the reactor train 30 and 22 of the isomerization zone. In the isomerization zone, the saturated feed stream contacts an alumina catalyst having 0.25 wt.% platinum and 5.5 wt.% chloride which was prepared by vacuum impregnating an alumina base in a solution of chloroplatinic acid, 2% hydrochloric acid, and 3.5% nitric acid and a volume ratio of 9 parts solution to 10 parts base to obtain a peptized base material having a solution to base ratio approximately 0.9. The preparation also included cold rolling the catalyst for approximately 1 hour by evaporation until dry. Afterward the catalyst was oxidized and the chloride content adjusted by contact with a 1 molar hydrochloric acid solution at 525° C. (975° F.) at a rate of 45 cc per hour for 2 hours. The catalyst was then reduced in electrolytic hydrogen at 565° C. (1050° F.) for 1 hour and was found to contain approximately 0.25 wt.% platinum and approximately 1 wt.% chloride. Impregnation of active chloride to a level of approximately 5.5 wt. % was accomplished by sublimating aluminum chloride with hydrogen and contacting the catalsyt with a sublimated aluminum chloride for approximately 45 minutes at 550° C.(1020° F.). The converted isomerization zone feed passed out of the reactor train at a temperature of 250 to 350° F. and a pressure of 450 psig and has the composition listed in the Table under stream 20.

The isomerization zone enters the stabilizer column 40 for the recovery of the product and removal of light gases. Column 40 has 30 trays and the feed enters above tray 15. The column splits the isomerization zone effluent into an overhead which is cooled and condensed to provide a recycle and a fuel gas stream having the composition given for line 46. An isomerization zone product is withdrawn from the bottom of stabilizer column 40 and has the composition given in the Table for line 48.

This example demonstrates the ability of the process to saturate benzene at mild conditions that prevent unwanted hydrocracking while yet providing enough heat to raise the feed to the isomerization zone to the desired isomerization temperature.

| | Stream Composition in kmol/hr | | | | | |
|---|---|---|---|---|---|---|
| | Stream Number | | | | | |
| Component | 10 | 16 | 34 | 20 | 46 | 48 |
| hydrogen | — | 47.2 | 17.8 | 5.1 | 5.1 | — |
| $C_1$-$C_4$ | — | — | 0.2 | 2.7 | 2.7 | — |
| isopentane | 11.7 | — | 11.7 | 23.9 | — | 23.9 |
| normal pentane | 18.9 | — | 18.9 | 7.6 | — | 7.6 |
| cyclopentane | 2.2 | — | 2.2 | 1.5 | — | 1.5 |
| dimethyl butane | 1.9 | — | 1.9 | 20.3 | — | 20.3 |
| methyl pentane | 19.7 | — | 19.6 | 25.2 | — | 25.2 |
| normal hexane | 20.6 | — | 20.5 | 5.5 | — | 5.5 |
| methyl cyclopentane | 13.5 | — | 13.5 | 6.7 | — | 6.7 |
| cyclohexane | 1.1 | — | 10.9 | 6.7 | — | 6.7 |
| benzene | 9.8 | — | — | — | — | — |
| $C_7$ and higher hydrocarbons | 0.6 | — | 0.6 | 1.0 | — | 1.0 |
| Total | 100.0 | 47.2 | 117.8 | 106.2 | 7.8 | 98.4 |

What is claimed is:

1. A process for the hydrogenation and decyclization of benzene and the isomerization of $C_4$-$C_6$ paraffins with a feedstock that comprises $C_4$14 $C_6$ paraffins and contains at least 2 wt.% benzene, said process comprising:

(a) combining said feedstock with a hydrogen-rich gas stream to produce a combined feed;

(b) passing said combined feed at a temperature of from 100°-250° F. to a hydrogenation zone and contacting said combined feed with a hydrogenation catalyst comprising a platinum group metal component and tin on a solid support or a platinum group metal component and cobalt and molybdenum on a solid support to saturate benezene and heat said feedstream to a temperature of from 200°-450° F.;

(c) recovering a saturated feedstream from said hydrogenation zone, said saturated feedstream having less than 0.1 wt. % benzene;

(d) passing at least a portion of said feedstream without additional heat input from the hydrogenation zone to an isomerization zone and contacting said feedstream with an isomerization catalyst at isomerization conditions and decyclization conditions; and (e) recovering an isomerate product from said isomerization zone.

2. The process of claim 1 wherein said feedstock comprises 10-25 wt.% benzene.

3. The process of claim 1 wherein said hydrogen gas stream is mixed with said feedstock to produce a hydrogen to hydrocarbon ratio of less than 0.1 in said feedstream.

4. The process of claim 1 wherein said feedstock comprises $C_5$-$C_6$ paraffins and cyclic hydrocarbons.

5. A process for the hydrogenation and decyclization of benzene and the isomerization of $C_5$-$C_6$ paraffins with a feedstock that comprises $C_5$-$C_6$ paraffins and contains at least 10 -25 wt,% benzene, said process comprising:

(a) combining said feedstock with a hydrogen-rich gas stream to produce a combined feed;

(b) passing said combined feed at a temperature of from 100°-250° F. to a hydrogenation zone and contacting said feed at hydrogenation conditions with a hydrogenation catalyst comprising a platinum group metal component on an alumina support and tin or a platinum group metal component and cobalt and molybdenum on an alumina support to saturate benzene and heat said feed;

(c) recovering a saturated feedstream from said hydrogenation zone, said saturated feedstream having less than 0.1 wt.% benzene and a temperature in a range of from 250°-350° F.;

(d) passing said saturated feedstream to an isomerization zone without additional heat input and contacting said feedstream with an isomerization catalyst at isomerization conditions and decyclization conditions; and (e) recovering an isomerate product from said isomerization zone.

6. The process of claim 5 wherein said hydrogenation conditions include a pressure of from 300 to 700 psig, a liquid hour space velocity of from 1 to 8 and a hydrogen to hydrocarbon ratio of from 0.1 to 2.

7. The process of claim 6 wherein said isomerization catalyst comprises a chlorided platinum catalyst on alumina support.

8. The process of claim 7 wherein a chloride concentration of from 30-300 ppm is maintained in said isomerization zone by injecting a chloride compound into said saturated feedstream.

9. The process of claim 1 wherein said isomerization zone includes at least two reactors in series, the first reactor is operated at conditions to open saturated hydrocarbon rings, said conditions including a temperature in excess of 290° F. and a pressure of at least 360 to 870 psig and the second reactor in the series is operated at conditions to increase the concentration of C5-C6 isoalkanes including a temperature in the range of from 140°-320°

* * * * *